US011268341B2

(12) United States Patent
Jabari et al.

(10) Patent No.: US 11,268,341 B2
(45) Date of Patent: Mar. 8, 2022

(54) WELLBORE PLUGS THAT INCLUDE AN INTERROGATION DEVICE, HYDROCARBON WELLS THAT INCLUDE THE WELLBORE PLUGS, AND METHODS OF OPERATING THE HYDROCARBON WELLS

(71) Applicant: ExxonMobil Upstream Research Company, Spring, TX (US)

(72) Inventors: Rami Jabari, The Woodlands, TX (US); Timothy J. Hall, Pinehurst, TX (US); P. Matthew Spiecker, Manvel, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 76 days.

(21) Appl. No.: 16/856,168

(22) Filed: Apr. 23, 2020

(65) Prior Publication Data

US 2020/0370390 A1 Nov. 26, 2020

Related U.S. Application Data

(60) Provisional application No. 62/852,540, filed on May 24, 2019, provisional application No. 62/925,325, filed on Oct. 24, 2019.

(51) Int. Cl.

| | |
|---|---|
| ***E21B 33/12*** | (2006.01) |
| ***E21B 47/12*** | (2012.01) |
| ***E21B 47/00*** | (2012.01) |

(52) U.S. Cl.
CPC ..... *E21B 33/12* (2013.01); *E21B 47/00* (2013.01); *E21B 47/12* (2013.01); *E21B 2200/08* (2020.05)

(58) Field of Classification Search
CPC ..... E21B 33/12; E21B 47/12; E21B 47/00; E21B 2200/08; E21B 33/1208; E21B 47/138
See application file for complete search history.

(56) References Cited

U.S. PATENT DOCUMENTS

| | | | | |
|---|---|---|---|---|
| 10,900,351 | B2 * | 1/2021 | Deffenbaugh | E21B 47/09 |
| 2008/0149345 | A1 * | 6/2008 | Marya | E21B 23/00 166/376 |
| 2010/0268470 | A1 * | 10/2010 | Kamal | E21B 47/13 702/13 |

(Continued)

*Primary Examiner* — Steven A MacDonald
(74) *Attorney, Agent, or Firm* — Leandro Arechederra, III

(57) ABSTRACT

Wellbore plugs that include an interrogation device, hydrocarbon wells that include the wellbore plugs, and methods of operating the hydrocarbon wells are disclosed herein. The wellbore plugs include a plug body, an interrogation device, and a sealing structure. The interrogation device is contained within the plug body and includes a sensor configured to detect at least one parameter of the hydrocarbon well. The hydrocarbon wells include a wellbore, a downhole tubular, the plug, and a communication device configured to receive communication data from the interrogation device. The methods include releasing an interrogation device from a plug, detecting at least one parameter within the hydrocarbon well with the interrogation device, transmitting communication data from the interrogation device, and receiving the communication data with a communication device.

23 Claims, 4 Drawing Sheets

(56) References Cited

U.S. PATENT DOCUMENTS

2011/0186290 A1* 8/2011 Roddy ..... E21B 47/10 166/253.1
2011/0187556 A1* 8/2011 Roddy ..... G01V 3/00 340/853.3
2011/0192592 A1* 8/2011 Roddy ..... E21B 47/005 166/250.01
2011/0192594 A1* 8/2011 Roddy ..... E21B 33/13 166/250.01
2011/0192597 A1* 8/2011 Roddy ..... E21B 43/25 166/253.1
2011/0199228 A1* 8/2011 Roddy ..... E21B 47/01 340/856.4
2011/0253373 A1* 10/2011 Kumar ..... E21B 23/10 166/306
2012/0279700 A1* 11/2012 Frazier ..... E21B 33/134 166/193
2016/0084075 A1* 3/2016 Ingraham ..... E21B 23/10 166/255.1
2016/0186044 A1* 6/2016 Rothrock ..... C09K 8/03 166/300
2017/0314372 A1* 11/2017 Tolman ..... E21B 43/116
2018/0010446 A1* 1/2018 Roberson ..... E21B 47/13
2018/0087369 A1* 3/2018 Sherman ..... G01N 33/24
2018/0094519 A1* 4/2018 Stephens ..... E21B 33/0355
2018/0306027 A1* 10/2018 Sherman ..... E21B 29/02
2019/0153799 A1* 5/2019 Hardesty ..... E21B 33/12
2019/0242808 A1* 8/2019 Chen ..... G01N 17/046
2019/0316459 A1* 10/2019 Chen ..... E21B 47/26
2019/0323342 A1* 10/2019 Pedersen ..... E21B 33/12
2020/0109624 A1* 4/2020 Parasram ..... H04L 63/0428
2020/0240258 A1* 7/2020 Stokely ..... E21B 33/16
2020/0332619 A1* 10/2020 Elliott ..... E21B 23/0413
2020/0378242 A1* 12/2020 Jabari ..... E21B 33/12

* cited by examiner

WELLBORE PLUGS THAT INCLUDE AN INTERROGATION DEVICE, HYDROCARBON WELLS THAT INCLUDE THE WELLBORE PLUGS, AND METHODS OF OPERATING THE HYDROCARBON WELLS

CROSS-REFERENCE TO RELATED APPLICATION

The present application is related to and claims the benefit of U.S. Provisional Application 62/852,540 filed May 24, 2019 entitled "Sensor Releasing Dissolvable Plugs." This application also claims the benefit of U.S. Provisional Application No. 62/925,325 filed Oct. 24, 2019 entitled, "Wellbore Plugs that Include an Interrogation Device, Hydrocarbon Wells that Include the Wellbore Plugs, and Methods of Operating the Hydrocarbon Wells."

FIELD OF THE DISCLOSURE

The present disclosure relates generally to wellbore plugs that include an interrogation device, to hydrocarbon wells that include the wellbore plugs, and/or to methods of operating the hydrocarbon wells.

BACKGROUND OF THE DISCLOSURE

Conventionally, coiled tubing is utilized to remove (e.g., to drill and/or mill out) plugs subsequent to completion operations. However, the reach of coiled tubing is limited. As such, dissolvable plugs often are utilized within region(s) of the wellbore that are beyond the reach of coiled tubing. While the dissolvable plugs are effective in certain circumstances, it is difficult to definitively know if and/or when the plugs have dissolved. It also is difficult to determine whether or not undissolved plugs, or other materials, are obstructing the wellbore. Thus, there exists a need for wellbore plugs that include an interrogation device that may be utilized to indicate destruction of the plug and/or obstruction of the hydrocarbon wells, for hydrocarbon wells that include the wellbore plugs, and/or for methods of operating the hydrocarbon wells.

SUMMARY OF THE DISCLOSURE

Wellbore plugs that include an interrogation device, hydrocarbon wells that include the wellbore plugs, and methods of operating the hydrocarbon wells are disclosed herein. The wellbore plugs include a plug body, an interrogation device, and a sealing structure. The plug body may be configured to be at least partially destroyed while the plug is positioned within a tubular conduit of a downhole tubular, which may extend within a wellbore of the hydrocarbon well. The interrogation device may be contained within the plug body and may include a sensor configured to detect at least one parameter within the hydrocarbon well. Responsive to at least partial destruction of the plug body, the interrogation device may be configured to be released from the plug body and into a wellbore fluid that extends within the wellbore. The sealing structure may be configured to form a fluid seal with the downhole tubular.

The hydrocarbon wells include the wellbore, the downhole tubular, the plug, and a communication device. The plug may be positioned within the tubular conduit, and the sealing structure may form a fluid seal with the downhole tubular. The communication device may be configured to receive communication data, which is indicative of the at least one parameter within the hydrocarbon well, from the interrogation device.

The methods include releasing an interrogation device from a plug, detecting at least one parameter within the hydrocarbon well with the interrogation device, transmitting communication data from the interrogation device, and receiving the communication data with a communication device of the hydrocarbon well. The releasing may include releasing from the plug and/or responsive to at least partial destruction of the plug. The detecting may include detecting with the interrogation device. The transmitting may include transmitting from the interrogation device. The communication data may be indicative of the at least one parameter within the hydrocarbon well.

DETAILED DESCRIPTION AND BEST MODE OF THE DISCLOSURE

Figure 1:
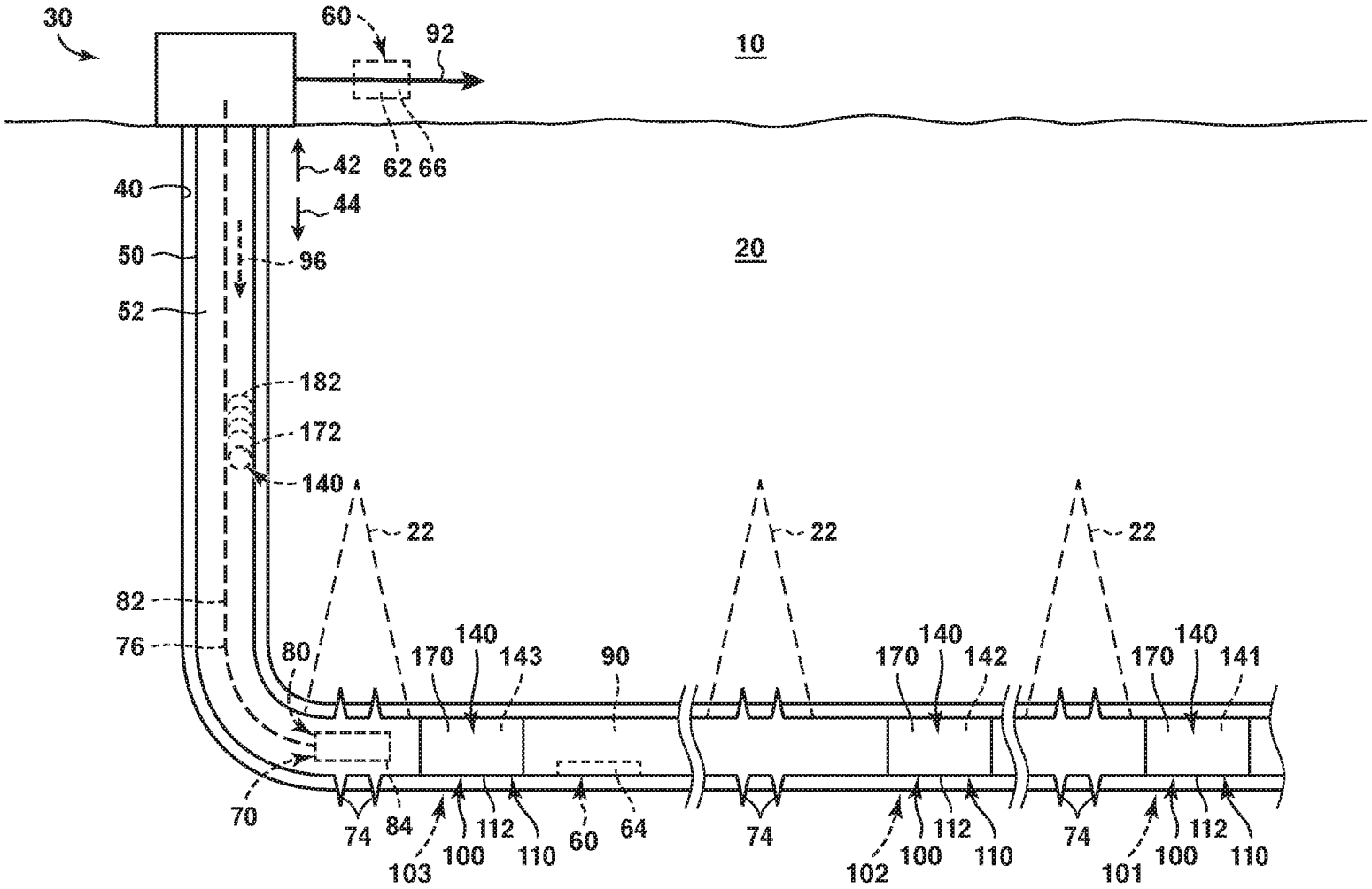
FIG. 1 is a schematic illustration of examples of hydrocarbon wells that may include at least one plug, according to the present disclosure.

FIGS. 1-8 provide examples of plugs 100, of hydrocarbon wells 30, and/or of methods 200, according to the present disclosure. Elements that serve a similar, or at least substantially similar, purpose are labeled with like numbers in each of FIGS. 1-8, and these elements may not be discussed in detail herein with reference to each of FIGS. 1-8. Similarly, all elements may not be labeled in each of FIGS. 1-8, but reference numerals associated therewith may be utilized herein for consistency. Elements, components, and/or features that are discussed herein with reference to one or more of FIGS. 1-8 may be included in and/or utilized with any of FIGS. 1-8 without departing from the scope of the present disclosure.

In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of hydrocarbon wells 30 that may include at least one plug 100, according to the present disclosure. Plugs 100 also may be referred to herein as frac plugs 100, as fracture plugs 100, and/or as downhole plugs 100. As illustrated in FIG. 1, hydrocarbon wells 30 include a wellbore 40 that extends within a subsurface region 20. Wellbore 40 also may be referred to herein as extending between a surface region 10 and a subterranean formation that may be present and/or defined within the subsurface region. Hydrocarbon wells 30 also include a downhole tubular 50 that extends, and/or that is positioned, within wellbore 40 and defines a tubular conduit 52.

Hydrocarbon wells 30 further include at least one plug 100. Plug 100 includes a plug body 120, an interrogation device 140, and a sealing structure 110. As discussed in more detail herein, plug body 120 may be configured to be at least partially destroyed while plug 100 is positioned within tubular conduit 52. As also discussed in more detail herein, interrogation device 140 may be contained within plug body 120 and may include a sensor 170. Sensor 170 may be configured to detect at least one parameter of hydrocarbon well 30 and may be configured to be released from plug body 120 and into contact with a wellbore fluid 90, which extends within wellbore 40, responsive to at least partial destruction of plug body 120. As also discussed in more detail herein, sealing structure 110 may be configured to form a fluid seal 112 with downhole tubular 50. Additional examples of plug 100 and/or of structures and/or functions that may be included in and/or utilized with plug 100 are disclosed herein.

Figure 8:
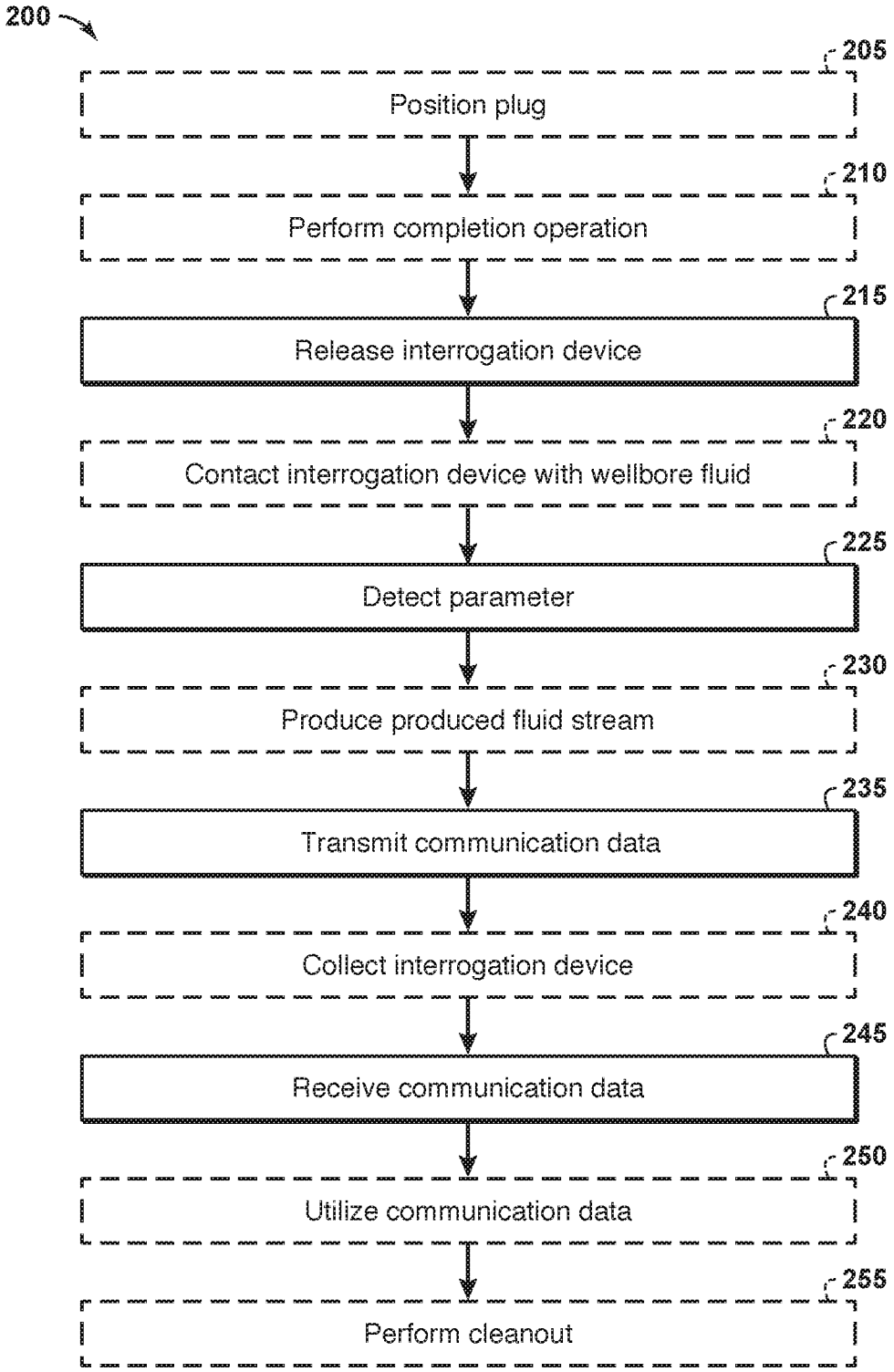
FIG. 8 is a flowchart illustrating examples of methods of operating a hydrocarbon well, according to the present disclosure.

During operation of hydrocarbon wells 30, and as discussed in more detail herein with reference to methods 200 of FIG. 8, one or more plugs 100 may be positioned within tubular conduit 52, as illustrated in FIG. 1. In the example of FIG. 1, the one or more plugs include a first plug 101, a second plug 102, and a third plug 103; however, it is within the scope of the present disclosure that hydrocarbon well 30 may include any suitable number of plugs 100.

Plugs 100 may be positioned within tubular conduit 52 in any suitable manner and/or for any suitable purpose. As an example, plugs 100 may be utilized as part of a completion, or fracturing, operation of hydrocarbon well 30. In this example, a given plug 100 may be utilized to fluidly isolate a region of tubular conduit 52 that is uphole from the given plug (e.g., in uphole direction 42 from the given plug) from a region of the tubular conduit that is downhole from the given plug (e.g., in downhole direction 44 from the given plug). In addition, a perforation device 70, such as a perforation gun and/or a shaped charge perforation device, may be positioned uphole from the given plug and may be utilized to create one or more perforations 74 within downhole tubular 50. Perforation device 70 may be positioned and/or supported within tubular conduit 52 by a tether 76.

A fracturing fluid 96 may be provided to the tubular conduit, may pressurize the fluid conduit, and/or may create one or more fractures 22 within subsurface region 20. This process may be repeated any suitable number of times; and, subsequent to completion of the fracturing operations, a corresponding number of plugs 100 may be positioned within the tubular conduit.

As discussed in more detail herein, plugs 100 may be configured to be at least partially destroyed while the plugs are positioned within the tubular conduit, and a given plug 100 may be configured to release a corresponding interrogation device 140 responsive to at least partial destruction of the given plug. In examples of hydrocarbon wells 30 that include the plurality of plugs 100, each plug 100 may include at least one corresponding interrogation device 140. As an example, first plug 101 may include at least one first corresponding interrogation device 141, second plug 102 may include at least one second corresponding interrogation device 142, third plug 103 may include at least one third corresponding interrogation device 143, etc.

The released interrogation device 140 may flow within wellbore fluid 90, may flow within tubular conduit 52, and/or may flow to surface region 10. The released interrogation device 140 may include a corresponding sensor 170 and/or may be configured to detect the at least one parameter within the hydrocarbon well subsequent to release from the given plug. The released interrogation device 140 further may transmit communication data 182 that may be indicative of the at least one parameter within the hydrocarbon well, and a communication device 60 of the hydrocarbon well may receive the communication data. With the above in mind, receipt of the communication data from the released interrogation device may provide hydrocarbon well 30 and/or an operator of the hydrocarbon well with additional information regarding downhole conditions within the hydrocarbon well. In a specific example, this additional information may be utilized to identify which plug 100 released the interrogation device, such as to indicate at least partial destruction of the plug. Other examples of the at least one parameter within the hydrocarbon well and/or of additional information that may be obtained from the communication data are disclosed herein.

Communication device 60 may include any suitable structure that may be adapted, configured, designed, and/or constructed to receive communication data 182 from interrogation device 140. In some examples, communication device 60 may be configured to receive communication data 182 from interrogation device 140 as the interrogation device flows past the communication device within a produced fluid stream 92 that is produced from the hydrocarbon well. In some examples, communication device 60 may include and/or be a downhole communication device, which may be positioned within subsurface region 20. Such a downhole communication device may be at least partially defined by, and/or may form a portion of, a downhole wireless network 64. In some examples, communication device 60 may include and/or be a surface communication device 62, which may be positioned within surface region 10. As additional examples, communication device 60 may include a wireless communication device, a wireless receiver, a wireless transmitter, an acoustic communication device, an acoustic receiver, an acoustic transmitter, an electromagnetic communication device, an electromagnetic receiver, an electromagnetic transmitter, and/or a Bluetooth communication device.

In some examples, communication device 60 may include a collection structure 66, which may be configured to separate interrogation device 140 from produced fluid stream 92. Examples of collection structure 66 include a screen, a filter, a sand trap, and/or a magnetic assembly. In these examples, communication device 60 may be configured to receive communication data 182 from interrogation device 140 subsequent to separation of the interrogation device from the produced fluid stream by the collection structure.

In some examples, as discussed in more detail herein, interrogation device 140 may include a unique identifier 172, which also may be referred to herein as an identification device 172. Examples of the unique identifier include a unique optical identifier, a unique radio frequency identifier, and/or a unique chemical identifier. Another example of the unique identifier includes an identification signal that may form a portion of communication data 182. In these examples, communication device 60 additionally or alternatively may be configured to detect the unique identifier, such as to permit and/or facilitate unique identification of the interrogation device and/or of the plug that released the interrogation device.

As an example, and as discussed, hydrocarbon well 30 may include a plurality of plugs 100, which may be spaced-apart along a length of tubular conduit 52. Each plug 100 may include at least one corresponding interrogation device 140. In this example, the unique identifier of each corresponding interrogation device 140 may uniquely identify the corresponding interrogation device and/or may permit the hydrocarbon well, the communication device, and/or the operator of the hydrocarbon well to determine and/or to discern which plug 100 released a given interrogation device 140. In a more specific example, and with reference to FIG. 1, first plug 101 and/or first interrogation device 141 thereof may include a first unique identifier, second plug 102 and/or second interrogation device 142 thereof may include a second unique identifier, and/or third plug 103 and/or third interrogation device 143 thereof may include a third unique identifier.

In some examples, and as also illustrated in dashed lines in FIG. 1, hydrocarbon well 30 may include a plug removal structure 80. Plug removal structure 80 may be adapted, configured, designed, and/or constructed to remove plug 100 from tubular conduit 52, such as to permit and/or facilitate fluid flow past the plug within the tubular conduit. In these examples, plug 100 may be configured to release interrogation device 140 while, or responsive to, being milled from the tubular conduit by the plug removal structure. An example of plug removal structure 80 includes a plug mill 84, which also may be referred to herein as a mill 84.

An umbilical 82, such as coiled tubing and/or a workover string, may support plug removal structure 80. The umbilical additionally or alternatively may be utilized to position the plug removal structure within the tubular conduit and/or may be utilized to power the plug removal structure during operation thereof.

Wellbore fluid 90 may include any suitable fluid that may be naturally and/or artificially positioned and/or present within wellbore 40. Examples of wellbore fluid 90 include water, an aqueous solution, and/or a hydrocarbon fluid.

Figure 2:
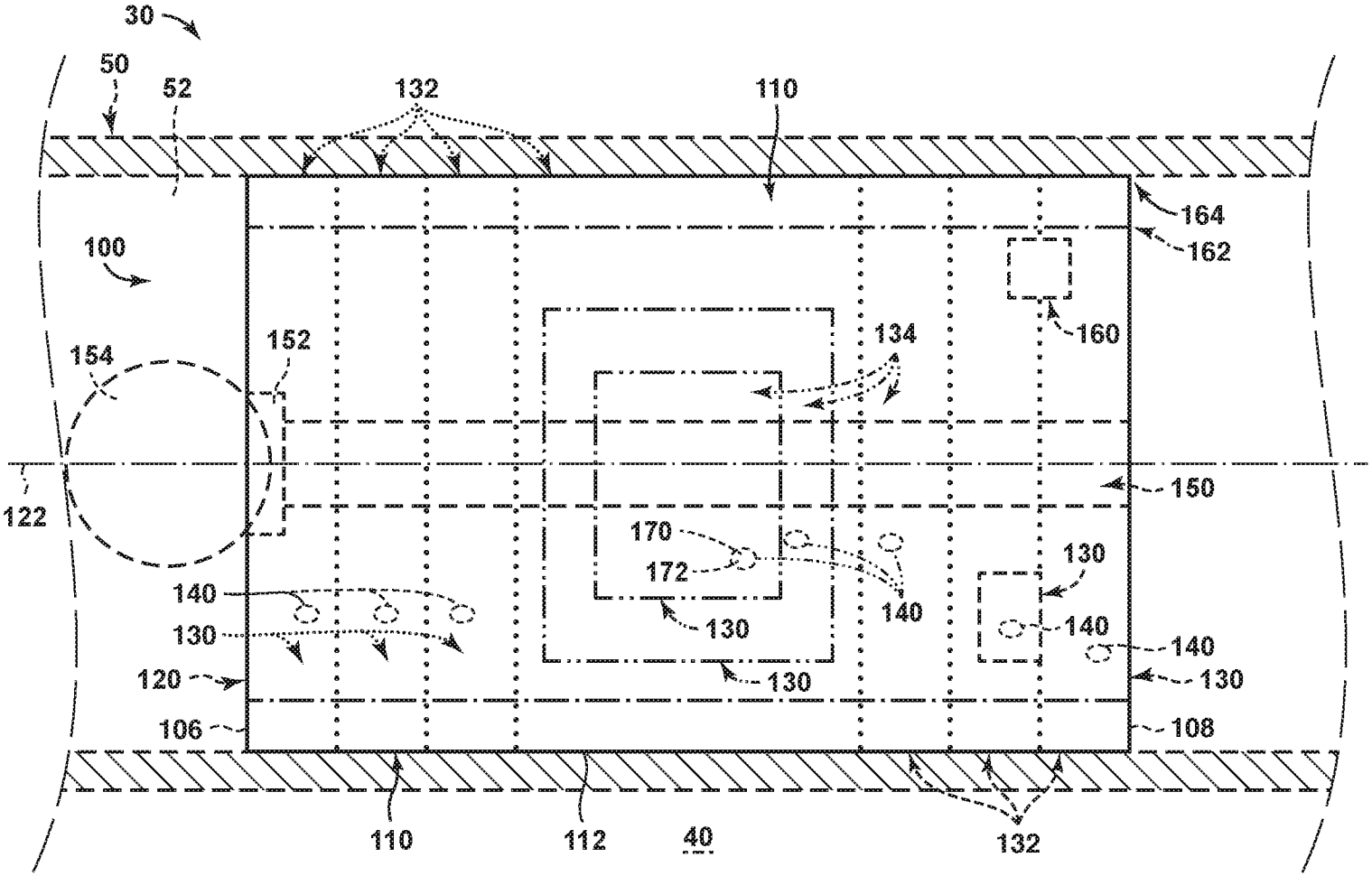
FIG. 2 is a schematic illustration of examples of a plug according to the present disclosure.

FIG. 2 is a schematic illustration of examples of a plug 100 according to the present disclosure. FIGS. 3-6 are less schematic illustrations of examples of plugs 100 according to the present disclosure. FIGS. 2-6 may be less schematic and/or more detailed illustrations of plugs 100 that are illustrated in combination with hydrocarbon wells 30 of FIG. 1. With this in mind, any of the structures, functions, and/or features that are disclosed herein with reference to plugs 100 of FIGS. 2-6 may be included and/or utilized with hydrocarbon wells 30 and/or plugs 100 of FIG. 1 without departing from the scope of the present disclosure. Similarly, any of the structures, functions, and/or features of that are disclosed herein with reference to hydrocarbon wells 30 and/or plugs 100 of FIG. 1 may be included in and/or utilized with plugs 100 of FIGS. 2-6 without departing from the scope of the present disclosure. Plugs 100 may include any suitable structure that may be positioned within tubular conduit 52, that may form fluid seal 112 with the tubular conduit, that may include at least one interrogation device 140, and/or that may release interrogation device 140, such as may be responsive to at least partial destruction of the plug.

As a specific example, and as discussed, plugs 100 may include plug body 120, at least one interrogation device 140, and sealing structure 110. Plug body 120 may be configured to be at least partially destroyed while the plug is positioned within tubular conduit 52 of downhole tubular 50. Interrogation device 140 may be contained within plug body 120 and may include sensor 170. Sensor 170 may be configured to detect at least one parameter within the hydrocarbon well. Interrogation device 140 may be configured to be released from plug body 120 and into wellbore fluid 90, which extends within a wellbore of the hydrocarbon well, responsive to at least partial destruction of the plug body. Sealing structure 110 may be configured to form, or to selectively form, fluid seal 112 with downhole tubular 50.

As discussed, plugs 100 may include, may be defined by, and/or may be at least partially defined by plug body 120. In some examples, plug body 120 may form and/or define an entirety of a given plug 100. In other examples, plug body 120 may form and/or define a fraction of the plug, and one or more other plug structures may form and/or define a remainder of the plug. As an example, plug body 120 may be soluble within wellbore fluid 90, while the one or more other plug structures of plug 100 may be insoluble within the wellbore fluid. In such an example, dissolution of plug body 120 may produce, may generate, and/or may be referred to herein as at least partial destruction of plug 100. Examples of the fraction of the plug that may be defined by plug body 120 include at least 10%, at least 20%, at least 30%, at least 40%, at least 50%, at least 60%, at least 70%, at least 80%, at most 99%, at most 90%, at most 80%, at most 70%, at most 60%, at most 50%, at most 40%, and/or at most 30% of an overall volume of the plug.

As discussed, plugs 100 may include and/or be soluble plugs 100. Such soluble plugs 100 may be configured to dissolve, to at least partially dissolve, to completely dissolve, to be at least partially destroyed, and/or to be completely destroyed upon and/or responsive to fluid contact with wellbore fluid 90. In these examples, the soluble plugs may be configured such that dissolution of the soluble plugs causes the soluble plugs to release one or more interrogation devices 140. Stated another way, release of one or more interrogation devices 140 may be responsive to and/or a result of dissolution of the soluble plugs.

Examples of plug materials, which may define plug body 120 and/or may be soluble within wellbore fluids 90, include a water-soluble material configured to dissolve upon contact with the wellbore fluid, a water-soluble polymer, polyglycolic acid (PGA), and/or polylactic acid (PLA). Soluble plugs additionally or alternatively may include a corrodible material that may, or that may be configured to, corrode upon contact with the wellbore fluid. Examples of such corrodible materials include a corrodible metal, aluminum, and/or magnesium.

In some examples, plugs 100 may include and/or be millable plugs 100 that may be configured to be mechanically milled from the tubular conduit, to be mechanically broken apart within the tubular conduit, to be mechanically removed from the tubular conduit, to be mechanically destroyed within the tubular conduit, and/or to be at least partially mechanically destroyed within the tubular conduit. Stated another way, the millable plugs may be configured to resist dissolution within wellbore fluid 90 and instead to be removed from the tubing conduit utilizing a mechanical removal tool, such as plug removal structure 80 of FIG. 1. However, this is not required of all examples, and it is within the scope of the present disclosure that a given plug may include and/or be both a soluble plug and a millable plug.

It is within the scope of the present disclosure that a given plug 100 may include any suitable number of interrogation devices 140. In some examples, given plug 100 may include a plurality of interrogation devices contained within plug body 120. Examples of the plurality of interrogation devices include at least 2, at least 5, at least 10, at least 20, at least 50, at least 100, at least 250, at least 500, and/or at least 1000 interrogation devices 140.

When the given plug 100 includes the plurality of interrogation devices 140, each interrogation device 140 may include a corresponding unique identifier 172. Examples of the unique identifier include a radio frequency identification device, an optical identification device, a chemical identification device, and/or an electronic identification device. Examples of the electronic identification device include a serial number and/or any other suitable hardware and/or software-based structure and/or algorithm that permits unique identification of each interrogation device 140.

Figure 3:
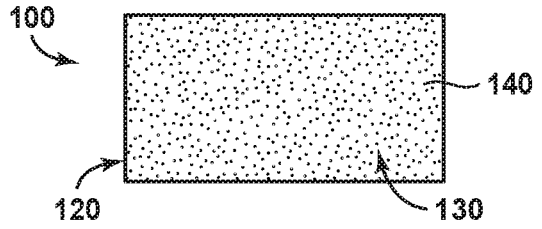
FIG. 3 is a less schematic illustration of an example of a plug according to the present disclosure.
Figure 4:
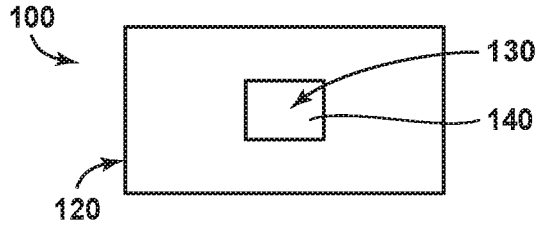
FIG. 4 is a less schematic illustration of an example of a plug according to the present disclosure.

In some examples, and as illustrated in FIGS. 2-3, the plurality of interrogation devices 140, when present, may be distributed throughout, may be at least substantially homogeneously distributed throughout, and/or may be homogeneously distributed throughout plug body 120 and/or an entirety of plug 100. In some examples, plug body 120 may include and/or define a device-containing region 130 that may include, contain, and/or house interrogation devices 140. In these examples, and as illustrated in dashed lines in FIG. 2 and in solid lines in FIG. 4, device-containing region 130 may be localized within a given, or a selected, region and/or portion of plug 100 and/or of plug body 120. Stated another way, device-containing region 130 may be formed and/or defined within a subset of plug body 120.

In some examples, the device-containing region may be embedded and/or encapsulated in and/or within a remainder of the plug body. Such a configuration may permit and/or facilitate release of one or more interrogation devices 140 subsequent to destruction and/or dissolution of the remainder, or of at least a region of the remainder, of the plug body. As an example, device-containing region 130 may be positioned within plug body 120 such that at least a threshold fraction of the plug body dissolves prior to exposure of the one or more interrogation devices to the wellbore fluid and/or prior to release of the one or more interrogation devices into the wellbore fluid. Examples of the threshold fraction of the plug body include at least 10%, at least 20%, at least 30%, at least 40%, at least 50%, at least 60%, at least 70%, at least 80%, at most 95%, at most 90%, at most 80%, at most 70%, at most 60%, and/or at most 50% of an overall volume of the plug body.

In some examples, the device-containing region may form and/or define an external surface of the plug body. Such a configuration may permit and/or facilitate release of the one or more interrogation devices responsive to, or responsive to initiation of, dissolution of the plug body.

Figure 5:
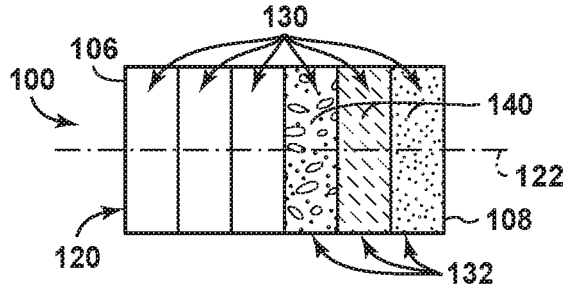
FIG. 5 is a less schematic illustration of an example of a plug according to the present disclosure.

In some examples, and as illustrated in dotted lines in FIG. 2 and in solid lines in FIG. 5, plug body 120 may include, have, and/or define a plurality of device-containing layers 132. Each device-containing layer 132 may be referred to herein as a, or as a separate, device-containing region 130 and may include at least one corresponding interrogation device 140. In some examples, the unique identifier of the at least one corresponding interrogation device 140 in each device-containing layer 132 may differ from the unique identifier of the at least one corresponding interrogation device 140 in each other device-containing layer 132. Such a configuration may permit and/or facilitate determination of which device-containing layer 132 of the plurality of device-containing layers currently is releasing the corresponding interrogation device 140.

In some examples, device-containing layers 132 may be flat and/or planar device-containing layers. In some examples, device-containing layers 132 may be arranged and/or positioned on an uphole plug end 106 of plug 100. In some examples, device-containing layers 132 may be arranged and/or positioned on a downhole plug end 108 of plug 100. In some examples, device-containing layers 132 may be arranged and/or distributed throughout an entirety of plug 100 and/or of plug body 120. In some examples, device-containing layers 132 may be arranged and/or distributed sequentially along an elongate axis 122 of plug 100 and/or of plug body 120.

Figure 6:
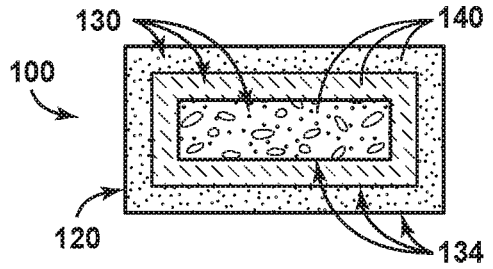
FIG. 6 is a less schematic illustration of an example of a plug according to the present disclosure.

In some examples, and as illustrated in dash-dot-dot lines in FIG. 2 and in solid lines in FIG. 6, plug body 120 may include, and/or device-containing layers 132 may be arranged in, a plurality of device-containing shells 134. Each device-containing shell 134 may be referred to herein as a device-containing region 130 and may include at least one corresponding interrogation device 140. In some examples, the unique identifier of the at least one corresponding interrogation device 140 in each device-containing shell 134 may differ from the unique identifier of the at least one corresponding interrogation device 140 in each other device-containing shell 134. Such a configuration may permit and/or facilitate determination of which device-containing shell of the plurality of device-containing shells currently is releasing the corresponding interrogation device 140. As illustrated, at least one device-containing shell 134 may cover, may coat, and/or may encapsulate at least one other device-containing shell 134.

Sealing structure 110 may include any suitable structure that may be configured to form, or to selectively form, fluid seal 112 with downhole tubular 50. As discussed, fluid seal 112, when formed, is configured to fluidly isolate a region of the tubular conduit that is uphole from the fluid seal from a region of the tubular conduit that is downhole from the fluid seal. Examples of sealing structure 110 include an elastomeric sealing structure and/or a metallic sealing structure. In some examples, sealing structure 110 may be defined, or at least partially defined, by plug body 120. In some examples, sealing structure 110 may be distinct from and/or may be defined by a different material from that of plug body 120.

As illustrated in dashed lines in FIG. 2, plug 100 may include an actuation mechanism 160. Actuation mechanism 160 may be configured to selectively transition plug 100 and/or sealing structure 110 thereof from a disengaged state 162, which is illustrated in dash-dot lines in FIG. 2, to an engaged state 164, which is illustrated in solid lines in FIG. 2. When in disengaged state 162, plug 100 may be configured, or may be free, to move within tubular conduit 52 and/or may not form fluid seal 112 with downhole tubular 50. In contrast, when in engaged state 164, plug 100 may operatively engage downhole tubular 50, may resist motion within tubular conduit 52, and/or may form fluid seal 112. An example of actuation mechanism 160 includes an expansion structure configured to expand sealing structure 110 to operatively engage the downhole tubular and/or to form the fluid seal. Another example of actuation mechanism 160 includes a compression structure configured to compress sealing structure 110 to operatively engage the downhole tubular with the sealing structure and/or to form the fluid seal.

In some examples, actuation mechanism 160 may be configured to receive an external force, or an external motive force, such as from a setting tool and/or from perforation device 70, to transition the sealing structure from the disengaged state to the engaged state. In such examples, actuation mechanism may include any suitable lever, cam, and/or bearing surface that may receive the external force and/or that may transition the sealing structure from the disengaged state to the engaged state responsive to receipt of the external force.

As discussed, plug 100 may include uphole plug end 106 and downhole plug end 108. As illustrated in dashed lines in FIG. 2, plug 100 also may include a through hole 150, which may extend between the uphole plug end and the downhole plug end. In these examples, plug 100 also may include a frac ball seat 152, which also may be referred to herein as a ball sealer seat 152, that may be defined on uphole plug end 106. Frac ball seat 152 may be configured to receive a frac sealer 154, which also may be referred to herein as a ball sealer 154. Receipt of the frac sealer may restrict fluid flow, via through hole 150, from uphole plug end 106 and/or toward downhole plug end 108.

Figure 7:
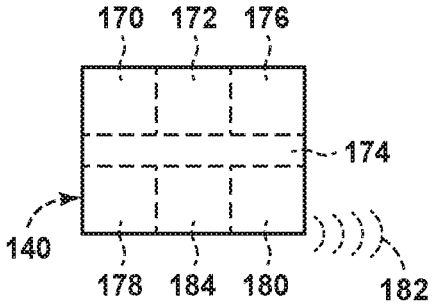
FIG. 7 is a schematic illustration of examples of interrogation devices that may be included in a plug, according to the present disclosure.

FIG. 7 is a schematic illustration of examples of interrogation devices 140 that may be included in a plug 100, according to the present disclosure, such as plugs 100 of FIGS. 1-6. Interrogation devices 140 of FIG. 7 may include and/or be a more detailed illustration of interrogation devices 140 that are illustrated in FIGS. 1-6 and/or discussed herein with reference thereto. With this in mind, any of the structures, functions, and/or features that are disclosed herein with reference to interrogation devices 140 of FIG. 7 may be included in and/or utilized with interrogation devices 140 of FIGS. 1-6 without departing from the scope of the present disclosure. Similarly, any of the structures, functions, and/or features that are disclosed herein with reference to interrogation devices 140 of FIGS. 1-6 may be included in and/or utilized with interrogation devices 140 of FIG. 7 without departing from the scope of the present disclosure.

As discussed, interrogation devices 140 include sensor 170, which may be configured to detect at least one parameter within the hydrocarbon well. Examples of sensor 170 include a temperature sensor, a pressure sensor, a pH sensor, a resistivity sensor, a vibration sensor, an acceleration sensor, a velocity sensor, and/or a magnetometer. Examples of the at least one parameter within the hydrocarbon well include a temperature within the hydrocarbon well, a pressure within the hydrocarbon well, a pH of the wellbore fluid, a resistivity of the wellbore fluid, a vibration within the hydrocarbon well, an acceleration of the interrogation device, a velocity of the interrogation device, a property of a magnetic field within the hydrocarbon well, a location of an obstruction within the hydrocarbon well, and/or a location of the interrogation device within the hydrocarbon well. Examples of the property of the magnetic field within the hydrocarbon well include a strength, a polarity, a direction, and/or a gradient of the magnetic field.

In some examples, interrogation devices 140 and/or sensors 170 thereof may be configured to detect the at least one parameter within the hydrocarbon well a single time and/or at a single location within the hydrocarbon well. In other examples, interrogation devices 140 and/or sensors 170 thereof may be configured to repeatedly detect the at least one parameter within the hydrocarbon well, such as to produce and/or generate information regarding a value of the at least one parameter within the hydrocarbon well as a function of time (e.g., a time trace of the at least one parameter within the hydrocarbon well as a function of time) and/or position (e.g., a position trace of the at least one parameter within the hydrocarbon well as a function of position within the tubular conduit).

In some examples, interrogation devices 140 may include and/or be electrically powered interrogation devices 140. In these examples, and as illustrated in dashed lines in FIG. 7, interrogation devices 140 may include an energy storage device 174. Energy storage device 174, when present, may be configured to electrically power the interrogation device and/or one or more other components of the interrogation device, such as sensor 170. In these examples, interrogation devices 140 further may include an initiation structure 176. Initiation structure 176, when present, may be configured to initiate electrical power of the interrogation device responsive to fluid contact between the interrogation device and the wellbore fluid and/or to initiate detection of the at least one parameter within the hydrocarbon well responsive to fluid contact between the interrogation device and the wellbore fluid. Examples of energy storage device 174 include any suitable battery and/or capacitor.

In some examples, and as illustrated in dashed lines in FIG. 7, interrogation devices 140 may include a memory device 178. Memory device 178, when present, may be configured to store data collected by the interrogation device. An example of the data includes the at least one parameter within the hydrocarbon well that is detected by sensor 170. Examples of memory device 178 include any suitable memory chip, random access memory device, programmable memory device, volatile memory device, and/or non-volatile memory device.

In some examples, and as illustrated in dashed lines in FIG. 7, interrogation devices 140 may include a data transmitter 180. Data transmitter 180, when present, may be configured to transmit communication data 182. As discussed in more detail herein, communication data 182 may be indicative of the at least one parameter within the hydrocarbon well that is detected by sensor 170 and/or may be transmitted to a communication device of the hydrocarbon well. Examples of data transmitter 180 include any suitable wireless, acoustic, Bluetooth, and/or electromagnetic transmitter.

In some examples, and as illustrated in dashed lines in FIG. 7, interrogation devices 140 may include a clock 184, which also may be referred to herein as an internal clock 184. Clock 184, when present, may be configured to record a time stamp for detection of the at least one parameter within the hydrocarbon well by sensor 170. Stated another way, clock 184 may permit interrogation device 140 to correlate a given value of the at least one parameter within the hydrocarbon well to a time at which the given value was determined and/or measured by sensor 170.

It is within the scope of the present disclosure that interrogation devices 140 may have and/or define any suitable density and/or may exhibit any suitable buoyancy within the wellbore fluid. As an example, interrogation devices 140 may be positively buoyant, or may float, within the wellbore fluid. Such a configuration may facilitate flow of the interrogation devices toward and/or to the surface region in vertical and/or toe-down hydrocarbon wells. As another example, interrogation devices 140 may be negatively buoyant, or may sink, within the wellbore fluid. Such a configuration may facilitate flow of the interrogation devices toward and/or to the surface region in horizontal and/or toe-up hydrocarbon wells. As yet another example, interrogation devices 140 may be neutrally, or at least substantially neutrally, buoyant within the wellbore fluid. Such a configuration may facilitate flow of the interrogation devices in and/or within the produced fluid stream. In some examples, a given hydrocarbon well 30 and/or a given plug 100 may include two or more of positively buoyant, negatively buoyant, and/or neutrally buoyant interrogation devices in any suitable relative proportion.

FIG. 8 is a flowchart illustrating examples of methods 200 of operating a hydrocarbon well, such as hydrocarbon well 30 of FIG. 1, according to the present disclosure. The hydrocarbon well includes a wellbore that extends within a subsurface region and a downhole tubular that extends within the wellbore and defines a tubular conduit. The hydrocarbon well also includes a plug positioned within the tubular conduit.

Methods 200 may include positioning the plug at 205 and/or performing a completion operation at 210 and include releasing an interrogation device at 215. Methods 200 also may include contacting the interrogation device with a wellbore fluid at 220 and include detecting a parameter at 225. Methods 200 further may include producing a produced fluid stream at 230 and include transmitting communication data at 235. Methods 200 also may include collecting the interrogation device at 240, include receiving communication data at 245, and may include utilizing the communication data at 250 and/or performing a cleanout at 255.

Positioning the plug at 205 may include positioning the plug within the tubular conduit. The positioning at 205 may be performed in any suitable manner. As an example, the positioning at 205 may include flowing the plug within the tubular conduit, from a surface region, and/or to a target and/or desired region within the tubular conduit. The positioning at 205 additionally or alternatively may include forming a fluid seal within the tubular conduit and with the plug, such as to resist fluid flow past the plug within the tubular conduit. The forming the fluid seal may include actuating a sealing structure of the plug, such as with an actuation mechanism of the plug. Examples of the plug, the tubular conduit, the sealing structure, the fluid seal, and/or the actuation mechanism are disclosed herein with reference to hydrocarbon wells 30, plugs 100, tubular conduits 52, sealing structures 110, fluid seals 112, and/or actuation mechanisms 160 of FIGS. 1-7.

The positioning at 205 may be performed with any suitable timing and/or sequence during methods 200. As examples, the positioning at 205 may be performed prior to the performing at 210 and/or prior to the releasing at 215.

Performing the completion operation at 210 may include performing any suitable completion operation within the subsurface region and with, via, and/or utilizing the hydrocarbon well. As an example, the performing at 210 may include perforating a portion of the downhole tubular with a perforation gun, which may be uphole from the plug within the tubular conduit. The performing at 210 additionally or alternatively may include pressurizing an uphole region of the tubular conduit, which is uphole from the plug, with a pressurizing fluid stream. The performing at 210 additionally or alternatively may include fracturing a portion of the subsurface region with, via, and/or utilizing the pressurizing fluid stream. Examples of the perforation gun are disclosed herein with reference to perforation device 70 of FIG. 1.

In some examples of methods 200, the performing at 210 may be repeated a plurality of times, such as to form a plurality of completions within the subsurface region, to form a plurality of spaced-apart perforations within a plurality of distinct regions of the downhole tubular, and/or to form a plurality of spaced-apart fractures within the subsurface region.

This repeating of the perforating at 210 may be accomplished in any suitable manner. As an example, the plug may be a first plug, the uphole region may be a first uphole region, the portion of the downhole tubular may be a first portion of the downhole tubular, and/or the portion of the subsurface region may be a first portion of the subsurface region. In this example, the performing at 210 may include repeating the positioning at 205 to position a second plug within the tubular conduit, repeating the perforating to perforate a second portion of the downhole tubular, repeating the pressurizing to pressurize a second uphole region of the tubular conduit, and/or repeating the fracturing to fracture a second portion of the subsurface region. In this example, the second plug may be uphole from the first plug within the tubular conduit, the second portion of the downhole tubular may be uphole from the first portion of the downhole tubular, the second uphole region of the tubular conduit may be uphole from the first uphole region of the tubular conduit, and/or the second portion of the subsurface region may be uphole from the first portion of the subsurface region.

The performing at 210 may be performed with any suitable timing and/or sequence during methods 200. As an example, the performing at 210 may be performed prior to the releasing at 215.

Releasing the interrogation device at 215 may include releasing the interrogation device from the plug and may be responsive, or at least partially responsive, to destruction, or to at least partial destruction, of the plug. Examples of the interrogation device are disclosed herein with reference to interrogation devices 140 of FIGS. 1-7.

In some examples, and as discussed in more detail herein, the plug may include and/or be a soluble plug. In these examples, methods 200 may include contacting the plug with the wellbore fluid and dissolving, or at least partially dissolving, the plug responsive to contact between the plug and the wellbore fluid. The dissolving the plug may produce and/or generate, may be referred to herein as, and/or may cause, at least partial destruction of the plug, and the releasing at 215 may be responsive, or at least partially responsive, to the dissolving. Stated another way, the interrogation device may be embedded and/or encapsulated within a plug body of the plug, the dissolving may include dissolving at least a region of the plug body, and dissolution of the region of the plug body may permit and/or facilitate release of the interrogation device from the plug.

In some examples, and as discussed in more detail herein, the plug may include and/or be a millable plug. In these examples, methods 200 may include milling the plug from the tubular conduit, which may be referred to herein as and/or may cause at least partial destruction of the plug, and the releasing at 215 may be responsive, or at least partially responsive, to the milling. Stated another way, the milling may remove a region of the plug, or the plug body of the plug, that surrounds, encapsulates, and/or retains the interrogation device, thereby permitting and/or facilitating release of the interrogation device from the plug.

The releasing at 215 may be performed with any suitable timing and/or sequence during methods 200. As examples, the releasing at 215 may be performed subsequent to the positioning at 205, subsequent to the performing at 210, prior to the contacting at 220, and/or prior to the detecting at 225. As a more specific example, and when methods 200 include the performing at 210, the releasing at 215 may be performed subsequent to conclusion of the performing at 210 and/or subsequent to completion of all desired regions of the hydrocarbon well.

Contacting the interrogation device with the wellbore fluid at 220 may include establishing fluid contact between the interrogation device and any suitable wellbore fluid that extends within the wellbore. Examples of the wellbore fluid are disclosed herein with reference to wellbore fluid 90 of FIG. 1.

The contacting at 220 may be performed with any suitable timing and/or sequence during methods 200. As examples, the contacting at 220 may be performed subsequent to the releasing at 215, at least partially concurrent with the releasing at 215, and/or prior to the detecting at 225.

Detecting the parameter at 225 may include detecting at least one parameter within the hydrocarbon well. This may include detecting the at least one parameter with, via, and/or utilizing the interrogation device. Examples of the at least one parameter within the hydrocarbon well are disclosed herein with reference to sensor interrogation device 140 and/or sensor 170 of FIGS. 1-7. Additional examples of the at least one parameter within the hydrocarbon well are disclosed herein with reference to the utilizing at 250.

The detecting at 225 may be performed with any suitable timing and/or sequence during methods 225. As an example, the detecting at 225 may be performed subsequent to the releasing at 215, subsequent to the contacting at 220, at least partially responsive to the contacting at 220, at least partially concurrent with the producing at 230, prior to the transmitting at 235, and/or at least partially concurrent with the transmitting at 235. In a specific example, and when methods 200 include the contacting at 220, methods 200 further may include initiating the detecting at 225 at least partially responsive to the contacting at 220. The initiating may be performed with, via, and/or utilizing an initiation structure of the interrogation device, examples of which are disclosed herein with reference to initiation structure 176 of FIG. 7.

Producing the produced fluid stream at 230 may include producing the produced fluid stream from the hydrocarbon well. Examples of the produced fluid stream are disclosed herein with reference to wellbore fluid 90 of FIG. 1. The producing at 230 may include flowing the interrogation device in the wellbore, flowing the interrogation device within the produced fluid stream, and/or producing the interrogation device from the hydrocarbon well within the produced fluid stream. This may include flowing the produced fluid stream from the subsurface region and/or into the surface region via the tubular conduit.

Stated another way, subsequent to the releasing at 215, the interrogation device may be entrained within the produced fluid stream and may flow through at least a portion of the wellbore within the produced fluid stream. Such a configuration, in some examples, may facilitate the collecting at 240, may facilitate the receiving at 245, and/or may permit the detecting at 225 to be performed at a plurality of spaced-apart locations along the length of the wellbore.

The producing at 230 may be performed with any suitable timing and/or sequence during methods 200. As examples, the producing at 230 may be performed subsequent to the positioning at 205, subsequent to the performing at 210, subsequent to the releasing at 215, subsequent to the contacting at 220, subsequent to the detecting at 225, at least partially concurrent with the releasing at 215, at least partially concurrent with the contacting at 220, at least partially concurrent with the detecting at 225, at least partially concurrent with the transmitting at 235, at least partially concurrent with the collecting at 240, and/or at least partially concurrent with the receiving at 240.

Transmitting communication data at 235 may include transmitting the communication data from the interrogation device. The communication data may be indicative of and/or based upon the at least one parameter within the hydrocarbon well that was detected during the detecting at 225. The transmitting at 235 may include transmitting the communication data in any suitable manner. As examples, the transmitting at 235 may include wirelessly transmitting the communication data such as via any suitable acoustic and/or electromagnetic communication mechanism. As another example, the transmitting at 235 may include transmitting with, via, and/or utilizing a data transmitter, examples of which are disclosed herein with reference to data transmitter 180 of FIG. 7.

The transmitting at 235 may be performed with any suitable timing and/or sequence during methods 200. As examples, the transmitting at 235 may be performed subsequent to the detecting at 225, at least partially concurrent with the producing at 230, subsequent to the collecting at 240, prior to the receiving at 245, and/or at least partially concurrent with the receiving at 245.

Collecting the interrogation device at 240 may include collecting the interrogation device in, within, and/or with a collection structure of the hydrocarbon well. The collection structure may be configured to separate the interrogation device from the produced fluid stream, such as to permit and/or facilitate the receiving at 245 and/or to improve a signal strength during the receiving at 245. Examples of the collection structure are disclosed herein with reference to collection structure 66 of FIG. 1.

The collecting at 240 may be performed with any suitable timing and/or sequence during methods 200. As examples, the collecting at 240 may be performed subsequent to the detecting at 225, at least partially concurrent with the producing at 230, prior to the transmitting at 235, and/or prior to the receiving at 245.

Receiving communication data at 245 may include receiving the communication data with a communication device of the hydrocarbon well. Examples of the communication device are disclosed herein with reference to communication device 60 of FIG. 1.

In some examples, the communication device may be positioned within the surface region. In these examples, the receiving at 245 may include receiving the communication data in the surface region and/or while the interrogation device also is within the surface region. In some examples, the communication device is a downhole communication device and/or is positioned within the subsurface region. In these examples, the receiving at 245 may include receiving the communication data in the subsurface region and/or while the interrogation device also is within the subsurface region.

As discussed in more detail herein, the communication data may include a single value for the at least one parameter within the hydrocarbon well and/or a plurality of values for the at least one parameter within the hydrocarbon well. As also discussed herein, when the communication data includes the plurality of values for the at least one parameter within the hydrocarbon well, each value for the at least one parameter within the hydrocarbon well may be associated with a location within the wellbore and/or with a collection time. With this in mind, the receiving at 245 may include receiving a time trace of the at least one parameter within the hydrocarbon well as a function of time and/or receiving a position trace of the at least one parameter within the hydrocarbon well as a function of position within the tubular conduit.

Utilizing the communication data at 250 may include utilizing the communication data in any suitable manner. As an example, and since the releasing at 215 may be responsive to at least partial destruction of the plug, the utilizing at 250 may include verifying the at least partial destruction of the plug. Stated another way, receipt of the communication data from the interrogation device, during the receiving at 245, may indicate that the interrogation device was released from the plug and thus may also indicate that the plug is at least partially, or even completely, destroyed.

The utilizing at 250 additionally or alternatively may include identifying at least one property of an obstruction that may be positioned within the tubular conduit based, at least in part, on the communication data. Examples of the at least one property of the obstruction include an extent of the obstruction, a relative location of the obstruction, an absolute location of the obstruction, and/or a fluid flow profile within the tubular conduit and/or proximate the obstruction.

In a specific example, the at least one parameter within the hydrocarbon well may include a fluid flow profile of the hydrocarbon well and/or within the tubular conduit. In this example, the at least one property of the obstruction may be identified based, at least in part, on the fluid flow profile of the hydrocarbon well.

In another specific example, the at least one parameter within the hydrocarbon well may include a location, within the hydrocarbon well, where the interrogation device is retained by the obstruction. In this example, the at least one property of the obstruction may be a location of the obstruction and/or may be based, at least in part, on the location where the interrogation device is retained by the obstruction.

The utilizing at 250 additionally or alternatively may include identifying a status of the plug based, at least in part, on the communication data. Examples of the status of the plug include a state of dissolution of the plug, such as via knowledge of a region of the plug that released the interrogation device, and/or a time at which the plug reaches, or reached, a given state of dissolution, such as via knowledge of a time at which the plug released the interrogation device.

As a more specific example, and as discussed herein, the plug may include a plurality of device-containing layers, and each device-containing layer may include a distinct corresponding interrogation device. In this example, the utilizing at 250 and/or the identifying the status of the plug may include which device-containing layer of the plurality of device-containing layers released the interrogation device, estimating a remaining fraction of the plug based, at least in part, on a unique identifier of the interrogation device, and/or estimating a rate of destruction of the plug based, at least in part, on an elapsed time between release of a first distinct corresponding interrogation device and release of a subsequent distinct corresponding interrogation device.

The utilizing at 250 additionally or alternatively may include identifying at least one property of fluid flow within the tubular conduit based, at least in part, on the communication data. Examples of the at least one property of fluid flow within the tubular conduit include a wellbore fluid velocity as a function of location along a length of the tubular conduit, a wellbore fluid acceleration profile as a function of location along the length of the tubular conduit, a wellbore fluid velocity as a function of time as the interrogation device flows within the tubular conduit, and/or a wellbore fluid acceleration as a function of time as the interrogation device flows within the tubular conduit.

In some examples, and as discussed, the hydrocarbon well may include a plurality of plugs that may be spaced-apart along a length of the tubular conduit. In these examples, each plug may form a corresponding fluid seal with the downhole tubular and/or may include a corresponding interrogation device. The corresponding interrogation device of each plug may include a corresponding identification device that uniquely identifies the corresponding interrogation device and/or that associates the corresponding interrogation device with each plug, and the communication data may include information regarding the corresponding identification device.

In these examples, the utilizing at 250 may include identifying a given plug of the plurality of plugs based, at least in part, on the communication data and/or on an identity of the corresponding identification device. This may include identifying an absolute location of the given plug within the tubular conduit, identifying a location of the given plug within the tubular conduit relative to the other plugs, and/or identifying which plug released the corresponding interrogation device.

In some examples, the identifying the given plug may include comparing an identity of the corresponding identification device to an identification device database. The identification device database may correlate an identity of each corresponding identification device to a corresponding plug that includes the corresponding identification device.

In some examples, the identifying the given plug further may include detecting an obstruction within the tubular conduit. In these examples, the obstruction may be detected based, at least in part, on receipt of communication data from a given corresponding interrogation device of a given plug and lack of receipt of communication data from another corresponding interrogation device of another plug that is downhole from the given plug. Stated another way, the presence of the obstruction between the given plug and the other plug may permit the given corresponding interrogation device to flow in an uphole direction within the tubular conduit but may preclude flow of the other corresponding interrogation device in the uphole direction within the tubular conduit. As such, lack of receipt of communication data from the other corresponding interrogation device may be utilized to indicate and/or to predict the presence of the obstruction between the given plug and the other plug and within the tubular conduit. In these examples, the utilizing at 250 further may include an approximate location of the obstruction based, at least in part, on a location of the given plug within the tubular conduit and a location of the other plug within the tubular conduit.

Performing the cleanout at 255 may include performing a cleanout operation to remove the obstruction from the hydrocarbon well and/or from the tubular conduit. When methods 200 include the performing at 255, the cleanout operation may be initiated and/or selected based, at least in part, on the at least one property of the obstruction that was determined during the utilizing at 250. Stated another way, knowledge of the at least one property of the obstruction, such as the extent of the obstruction, the relative location of the obstruction, the absolute location of the obstruction, and/or the fluid flow profile within the tubular conduit and/or proximate the obstruction may permit and/or facilitate improved timing for initiation of the cleanout operation and/or improved selection of the methodology and/or hardware that may be utilized to perform the cleanout operation.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A plug configured to be positioned within a tubular conduit of a downhole tubular that extends within a wellbore of a hydrocarbon well, the plug comprising:

a plug body configured to be at least partially destroyed while the plug is positioned within the tubular conduit;

a plurality of interrogation devices contained within the plug body, wherein each interrogation device includes a sensor configured to detect at least one parameter within the hydrocarbon well, and further wherein each interrogation device is configured to be released, from the plug body and into a wellbore fluid that extends within the wellbore, responsive to at least partial destruction of the plug body; and a sealing structure configured to form a fluid seal with the downhole tubular, wherein each interrogation device includes a corresponding unique identifier that uniquely identifies each interrogation device.

2. The plug of claim 1, wherein at least one of the plurality of interrogation devices includes an initiation structure configured to at least one of:

(i) initiate electrical power of the at least one of the plurality of interrogation devices responsive to fluid contact between the at least one of the plurality of interrogation devices and the wellbore fluid; and (ii) initiate detection of the at least one parameter within the hydrocarbon well responsive to fluid contact between the at least one of the plurality of interrogation devices and the wellbore fluid.

3. The plug of claim 1, wherein the at least one of the plurality of interrogation devices includes at least one of:

(i) a memory device configured to store data collected by the at least one of the plurality of interrogation devices;

(ii) a data transmitter configured to transmit communication data indicative of the at least one parameter detected by the sensor; and (iii) an internal clock configured to record a time stamp for detection of the at least one parameter detected by the sensor.

4. The plug of claim 1, wherein the plurality of interrogation devices is at least substantially homogeneously distributed throughout the plug body.

5. The plug of claim 1, wherein the plug body includes a plurality of device-containing layers, wherein at least one interrogation device of the plurality of interrogation devices is positioned within each device-containing layer of the plurality of device-containing layers.

6. The plug of claim 5, wherein the corresponding unique identifier of the at least one interrogation device is associated with a corresponding device-containing layer of the plurality of device-containing layers.

7. The plug of claim 1, wherein the plug body includes a device-containing region that contains the plurality of interrogation devices, wherein the device-containing region is defined within a subset of the plug body.

8. A hydrocarbon well, comprising:

a wellbore that extends within a subsurface region;

a downhole tubular that extends within the wellbore and defines a tubular conduit;

the plug of claim 1 positioned within the tubular conduit, wherein the sealing structure forms the fluid seal with the downhole tubular; and a communication device configured to receive communication data indicative of the at least one parameter within the hydrocarbon well from the plurality of interrogation devices.

9. The hydrocarbon well of claim 8, wherein the communication device at least one of:

(i) includes a surface communication device that is positioned within the surface region; and (ii) includes a downhole wireless communication network.

10. The hydrocarbon well of claim 8, wherein the communication device further is configured to at least one of:

(i) detect an optical identifier of at least one of the plurality of interrogation devices;

(ii) detect a radio frequency identifier of at least one of the plurality of interrogation devices; and (iii) detect a chemical identifier of at least one of the plurality of interrogation devices.

11. The hydrocarbon well of claim 8, wherein the communication device includes a collection structure configured to separate at least one of the plurality of interrogation devices from a produced fluid stream that is produced from the hydrocarbon well.

12. The hydrocarbon well of claim 8, wherein the hydrocarbon well includes a plurality of plugs spaced-apart along a length of the tubular conduit, wherein each plug of the plurality of plugs forms a corresponding fluid seal and includes a corresponding interrogation device, wherein the corresponding interrogation device includes a corresponding identification device that uniquely identifies the corresponding interrogation device.

13. The hydrocarbon well of claim 12, wherein the communication device is configured to identify which plug of the plurality of plugs releases a given corresponding interrogation device based, at least in part, on at least one of:

(i) the corresponding identification device;

(ii) identification of the corresponding identification device; and (iii) receipt of an identification signal from the corresponding identification device.

14. A method of operating a hydrocarbon well, wherein the hydrocarbon well includes a wellbore that extends within a subsurface region, a downhole tubular that extends within the wellbore and defines a tubular conduit, and a plug positioned within the tubular conduit, the method comprising:

releasing, from the plug, an interrogation device, wherein the releasing is responsive to at least partial destruction of the plug;

contacting the interrogation device with a wellbore fluid that extends within the wellbore;

detecting at least one parameter within the hydrocarbon well with the interrogation device upon contacting the interrogation device with the wellbore fluid;

transmitting, from the interrogation device, communication data indicative of the at least one parameter within the hydrocarbon well; and receiving, with a communication device of the hydrocarbon well, the communication data.

15. The method of claim 14, wherein the receiving includes receiving at least one of:

(i) a time trace of the at least one parameter within the hydrocarbon well as a function of time; and (ii) a position trace of the at least one parameter within the hydrocarbon well as a function of position within the tubular conduit.

16. The method of claim 14, wherein the communication device includes a downhole wireless network, and further wherein the method includes performing the receiving while the interrogation device is positioned within the subsurface region.

17. The method of claim 14, wherein the receiving includes verifying the at least partial destruction of the plug.

18. The method of claim 14, wherein the method further includes identifying at least one property of an obstruction that is positioned within the tubular conduit based, at least in part, on the communication data.

19. The method of claim 18, wherein the method further includes performing a cleanout operation to remove the obstruction from the hydrocarbon well, wherein the cleanout operation is based, at least in part, on the at least one property of the obstruction.

20. The method of claim 14, wherein the method further includes identifying a status of the plug based, at least in part, on the communication data.

21. The method of claim 20, wherein the plug includes a plurality of device-containing layers, wherein each device-containing layer of the plurality of device-containing layers includes a distinct corresponding interrogation device, and further wherein the identifying the status of the plug includes at least one of:

(i) identifying which device-containing layer of the plurality of device-containing layers released the interrogation device;

(ii) estimating a remaining fraction of the plug based, at least in part, on a unique identifier of the interrogation device; and (iii) estimating a rate of destruction of the plug based, at least in part, on an elapsed time between release of a first distinct corresponding interrogation device and release of a subsequent distinct corresponding interrogation device.

22. The method of claim 14, wherein the method further includes identifying at least one fluid flow property within the tubular conduit based, at least in part, on the communication data.

23. The method of claim 14, wherein the hydrocarbon well includes a plurality of plugs spaced-apart along a length of the tubular conduit, wherein each plug of the plurality of plugs forms a corresponding fluid seal with the downhole tubular and includes a corresponding interrogation device, wherein each corresponding interrogation device includes a corresponding identification device that uniquely identifies the corresponding interrogation device, and further wherein the method includes identifying a given plug of the plurality of plugs based, at least in part, on an identity of the corresponding identification device.

* * * * *